US005501286A

United States Patent [19]

Berry

[11] Patent Number: 5,501,286

[45] Date of Patent: Mar. 26, 1996

[54] METHOD AND APPARATUS FOR DISPLACING A TOP DRIVE TORQUE TRACK

[75] Inventor: Joe R. Berry, The Woodlands, Tex.

[73] Assignee: Bowen Tools, Inc., Houston, Tex.

[21] Appl. No.: 316,085

[22] Filed: Sep. 30, 1994

[51] Int. Cl.[6] ..... E21B 19/00

[52] U.S. Cl. ..... 175/52; 175/57; 175/85; 175/203

[58] Field of Search ..... 175/57, 85, 52, 175/195, 203; 166/77.5, 85, 332

[56] References Cited

U.S. PATENT DOCUMENTS

| | | | |
|---|---|---|---|
| 1,375,092 | 4/1921 | Hanson . | |
| 1,395,706 | 11/1921 | Greve . | |
| 2,979,143 | 5/1958 | Kandle . | |
| 2,998,084 | 7/1957 | Johnson et al. . | |
| 3,009,521 | 7/1958 | Failing . | |
| 3,126,063 | 6/1960 | Pitt et al. . | |
| 3,404,741 | 10/1968 | Gheorghe et al. . | |
| 3,464,507 | 9/1969 | Alexander et al. . | |
| 3,766,991 | 10/1973 | Brown . | |
| 3,857,450 | 12/1974 | Guier . | |
| 3,915,244 | 10/1975 | Brown . | |
| 4,126,193 | 11/1978 | Brown . | |
| 4,147,215 | 4/1979 | Hodge et al. . | |
| 4,421,179 | 12/1983 | Boyadjieff . | |
| 4,437,524 | 3/1984 | Boyadjieff . | |
| 4,449,596 | 5/1984 | Boyadjieff . | |
| 4,458,768 | 7/1984 | Boyadjieff . | |
| 4,610,315 | 9/1986 | Koga et al. . | |
| 4,625,796 | 12/1986 | Boyadjieff . | |
| 4,800,968 | 1/1989 | Shaw et al. | 175/85 |
| 4,865,135 | 9/1989 | Moses . | |
| 4,878,546 | 11/1989 | Shaw et al. | 175/85 X |
| 5,038,871 | 8/1991 | Dinsdale | 175/52 |
| 5,107,940 | 4/1992 | Berry . | |
| 5,211,251 | 5/1993 | Woolslayer | 175/85 |
| 5,251,709 | 10/1993 | Richardson . | |

FOREIGN PATENT DOCUMENTS

| | | |
|---|---|---|
| 157230 | 1/1982 | Norway . |
| 164557 | 3/1983 | Norway . |

OTHER PUBLICATIONS

*World Oil*, "DC Electric Power Swivel Can Save Time and Money", pp. 36–39, Jan. 1972.

*World Oil*, "More About New Equipment", p. 257, Apr. 1979.

*Primary Examiner*—Frank S. Tsay

*Attorney, Agent, or Firm*—Pravel, Hewitt, Kimball & Krieger

[57] ABSTRACT

A method and apparatus for displacing the lower end of a torque track used to support a top drive drilling unit. The top drive drilling unit is suspended from the lower end of the torque track and then displaced in a first direction away from the location of the drill string. Sequentially, or concurrently, the lower end of the torque track and top drive unit are displaced in a second direction substantially normal to the first direction, resulting in the full displacement of the top drive unit and the lower end of the torque track sufficiently to enable the removal of multiple sections of drill pipe without interference by the torque track or the top drive drilling unit.

14 Claims, 8 Drawing Sheets

METHOD AND APPARATUS FOR DISPLACING A TOP DRIVE TORQUE TRACK

BACKGROUND OF THE INVENTION

1. Field of the Invention

The present invention relates to a method and apparatus for displacing a torque track used to guide a top drive drilling unit. More particularly, the present invention relates to a method and apparatus for displacing the lower end of a torque track which is used to guide a top drive unit to drill an oil or gas well.

2. Description of the Prior Art

It is well known in the prior art to use a top drive drilling unit to rotate the drill stem of an oil and gas well. See, for example, U.S. Pat. Nos. 4,449,596; 3,464,507; and 3,766,991 and pending U.S. application Ser. No. 050,537, filed Apr. 20, 1993. A top drive drilling unit is suspended by a cable from the crown of a mast of a drilling rig above the drill string. Essentially, the unit rotates the drill string from the top side as opposed to the use of a rotary table and related equipment at the rig floor.

A top drive unit usually requires a track which runs the length of the mast to guide the top drive, to restrain it from lateral movement and to transfer torsional loads originating from the rotary drilling operation into the derrick substructure. Such torque drive track systems are disclosed in U.S. Pat. Nos. 4,865,135 5,251,709 and pending U.S. patent application Ser. No. 217,689, filed Mar. 24, 1994.

In the process of drilling a well, it may be advantageous to disconnect the drill string from the top drive unit and handle sections of drill pipe without the top drive unit in place. In these instances, it is preferable to disconnect the top drive unit from the draw works and move it away from immediately above the drill string. See, for example, U.S. Pat. Nos. 4,421,179; 4,437,524 and 4,458,768. However, such prior designs are complex and cumbersome. If this operation can be performed in a quick and efficient manner by use of a single configuration, the amount of time required to add or remove joints of drill string can be significantly improved. Accordingly, there is a need for an improved method and apparatus for temporarily suspending the top drive and displacing it from a location immediately above the drill site to permit the draw works and other equipment to add or remove sections of drill pipe without interference by the top drive.

SUMMARY OF THE INVENTION

The present invention provides an apparatus and method for displacing the lower end of a torque track suspended from a derrick. The apparatus includes a first means for displacing the lower end of the torque track in a direction away from the location of the well. A second means is included for displacing the lower end of a torque track in a second direction, preferably substantially normal to the first direction. The top drive unit is disconnected from the draw works and suspended from the torque track. In this manner, the top drive and torque track are moved rearwardly and laterally, away from the drill string sufficiently far to add or remove sections of drill string without interference by the top drive or torque track.

The method comprises the disengagement of the drill string from the top drive unit. The top drive unit is suspended from the torque track, preferably its lower end. The lower end of the torque track is then displaced in a first direction. Concurrently, or sequentially, the lower end may be displaced in a second direction. The second direction may be substantially normal to the first direction.

Preferably, the top drive is suspended from the torque track by a linkage assembly which engages that portion of the top drive which slides along the torque track. The linkage assembly is pivoted from a passive to an active position engaging the carriage of the top drive and suspending it from the torque track, preferably near the lower end of the track.

The first means for displacing the lower end of the torque track includes a base which is in spaced relationship with the derrick, a linkage assembly including an articulated member attached at one end to the torque track and at its other end to the base, and hydraulic means or other mechanism for pivoting the articulated member displacing the lower end of the torque track in a first direction.

The second means for displacing the lower end of the torque track includes a linkage assembly having an articulated member attached at one end to the base of the first displacing means and at its other end to the derrick. The second means also includes hydraulic means or other mechanism for pivoting the articulated member displacing the base and the lower end of the torque track in a second direction, preferably substantially normal to the first direction.

In this manner, the lower end of the torque track is eventually displaced to a rear corner of the rig floor (see FIG. 8) at about a 45° angle if the displaced distances along the first and second directions are substantially equal. The angle of displacement is not significant. Rather, what is significant is displacement of the top drive (once suspended from the torque track) and the torque track, a sufficient distance to permit sections of drill pipe to be removed without interference by the top drive and/or the torque track.

The more important features of this invention have been summarized rather broadly in order that the detailed description be better understood. There are, of course, additional features of the invention that will be described hereinafter and which will also form the subject of the claims appended hereto.

BRIEF DESCRIPTION OF THE DRAWINGS

In order to more fully describe the drawings used in the detailed description of the present invention, a brief description of each drawing is provided.

DETAILED DESCRIPTION OF PREFERRED EMBODIMENT

Figure 1:
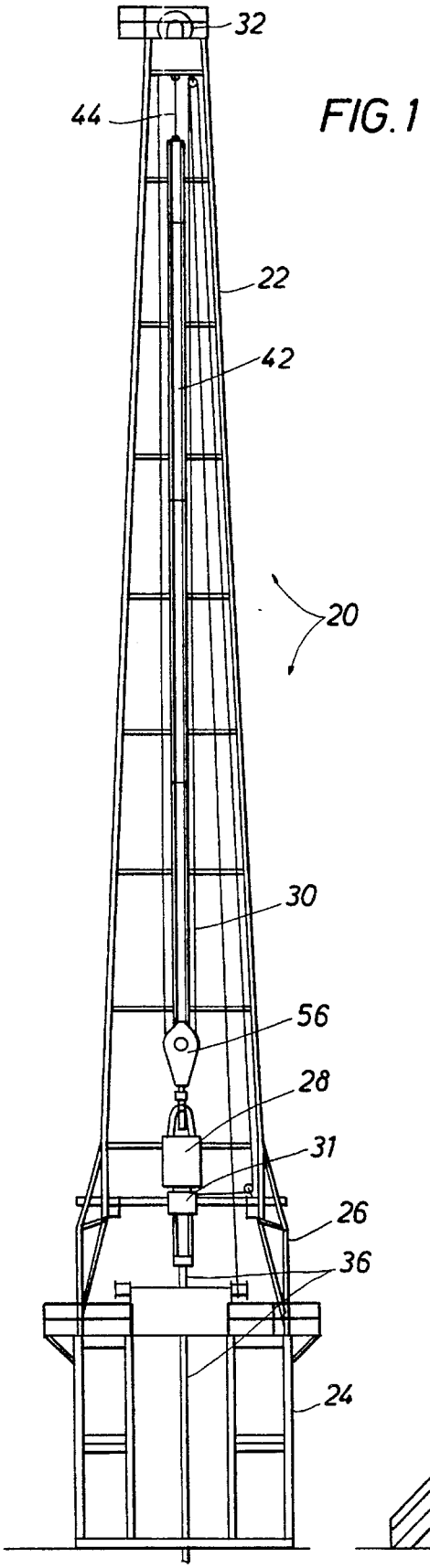
FIG. 1 is a front elevation view of the present invention installed in a derrick.

Referring to FIGS. 1–4, a conventional drilling rig or derrick 20 is shown having a mast 22, substructure 24 and an A-frame 26 which supports and stabilizes mast 22 on substructure 24. Also shown is a top drive drilling unit 28 suspended from a cable arrangement 30, a portion of which loops around crown block 32, and in turn is tensioned for upward movement by a motor (not shown) supported at the rig floor. A drill string 36 is suspended by top drive drilling unit 28. Top drive unit 28 includes a power swivel 31 to rotate drill string 36. Drill string 36 passes through substructure 24 into the ground.

Top drive unit 28 includes a carriage assembly 40 (see FIG. 2) which moves along a torque track 42. Torque track 42 is comprised of a series of track segments, for example, 42*a*–42*e*. At its upper end, track segment 42*a* of torque track 42 is suspended by a cable 44 which is attached to the structural framework of mast 22. At its lower end, track segment 42*e* of torque track 42 is attached by members 50 and 52 back to A-frame 26. The combination of members 50 and 52 is occasionally referred to as a strong back. In this manner, any torsional load which is introduced into the torque track 42 as a result of the rotation of top drive drilling unit 28 is resisted by the strong back frame arrangement which transfers most of the torsional loads and forces into substructure 24 rather than mast 22. The configuration and assembly of torque track 42 is disclosed in further detail in co-pending U.S. patent application Ser. No. 217,689, filed Mar. 24, 1994, which U.S. patent application is hereby incorporated by reference and made a part of this detailed description.

Figure 2:
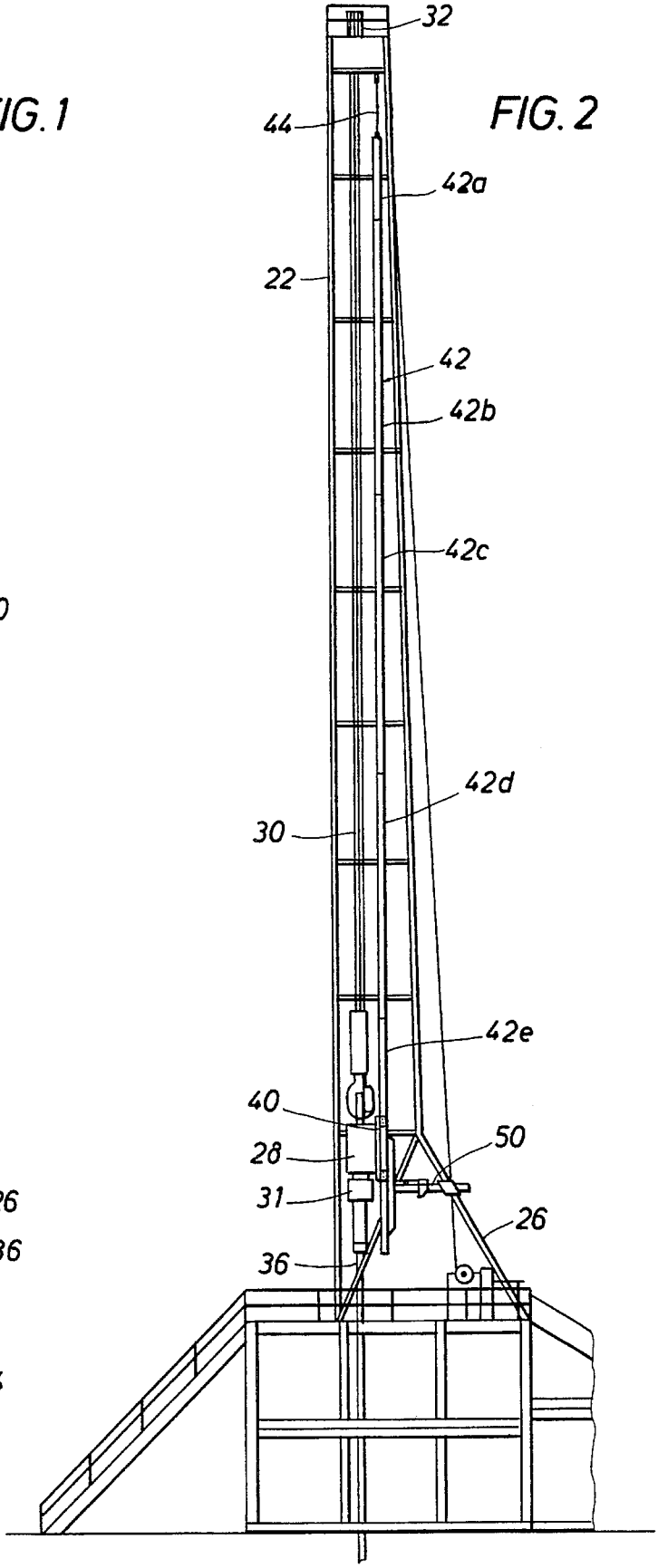
FIG. 2 is a side elevation view of the present invention installed in a derrick.

Referring now to FIGS. 1 and 2, top drive unit 28 and power swivel 31 are shown in an operational or drilling mode directly above drill string 36. Periodically, it is necessary to add or remove a series of sections of drill string 36. For example, during a tripping operation as many as 100 sections (or more) of 30–90 foot lengths of drill string may be removed. Such a tripping operation may be required to replace a drill bit which may be necessary every 12–18 hours of drilling. Thus, it is advantageous to have torque track 42 and top drive unit 28 displaced from a position immediately above the drill string as shown in FIGS. 1 and 2. This will speed up the operation by removing the added weight associated with the top drive unit and the additional interference caused by its proximity to the drill string.

Figure 3:
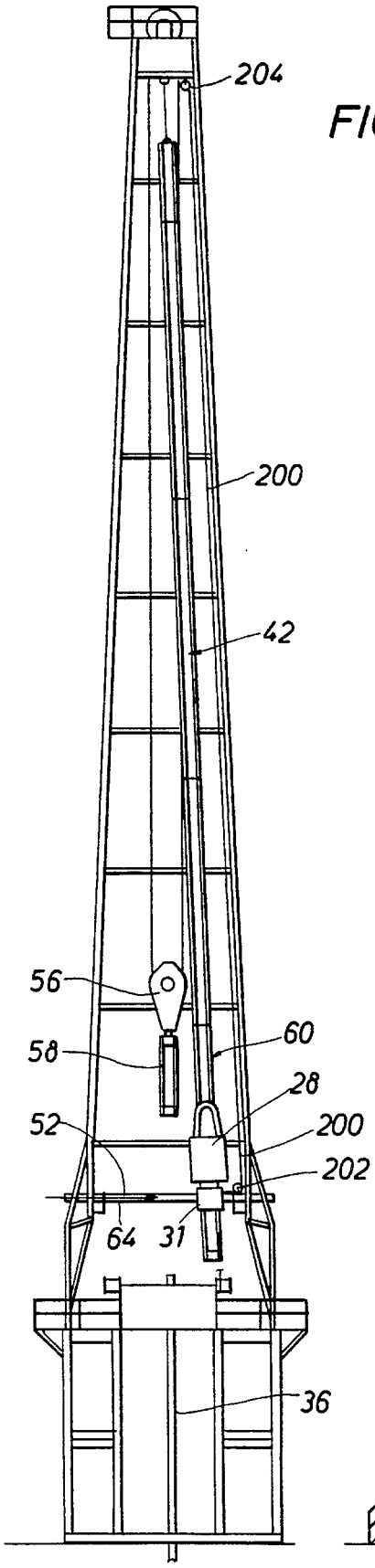
FIG. 3 is a front elevation view of the present invention with the torque track displaced in a lateral direction.
Figure 4:
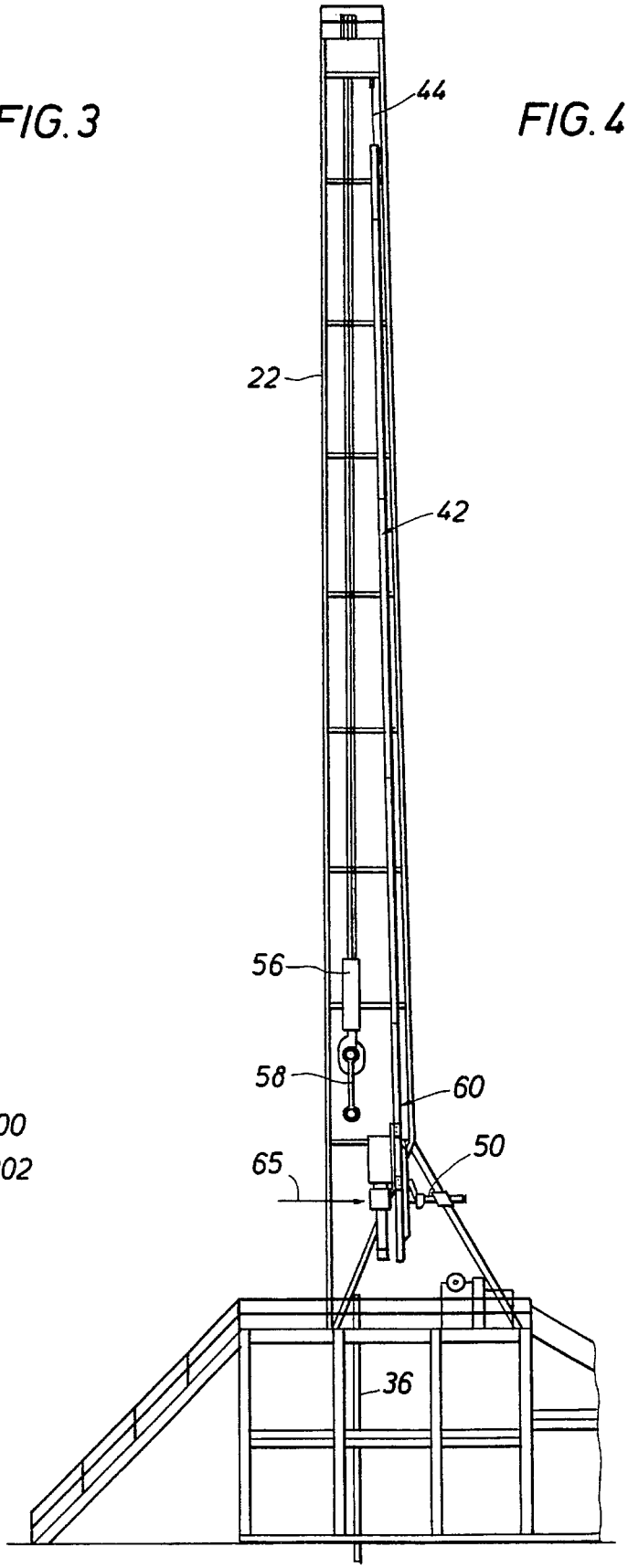
FIG. 4 is a side elevation view of the present invention with the torque track displaced rearwardly.

Referring now to FIGS. 3 and 4, the principles associated with the present invention are shown. That is, following disconnection of the top drive from the drill string, top drive unit 28 is suspended from lower end 60 of torque track 42, as described below, and block 56 is disconnected. This frees up block 56 to handle a second set of elevators 58 to remove sections of drill string. With respect to FIG. 3, lower end 60 of torque track 42, which is suspending top drive 28, has been displaced in a lateral direction shown by arrow 64. Obviously, torque track 42 can be displaced in a direction opposite to arrow 64 and accomplish the same lateral displacement necessary to practice the invention. In FIG. 4, the lower end 60 of torque track 42 has been displaced in a rearward direction shown by arrow 65. Displacement along the directions shown by arrows 64 and 65 need not occur in any particular order. Indeed, the displacement need not occur in precisely that direction. The displacement along the directions shown by arrows 64 and 65 may represent vectors. That is, if the lower end 60 of torque track 42 is displaced to one corner of the rig floor in the directions of arrows 64 and 65 simultaneously, arrows 64 and 65 merely represent vector components of the final displacement.

Figure 5:
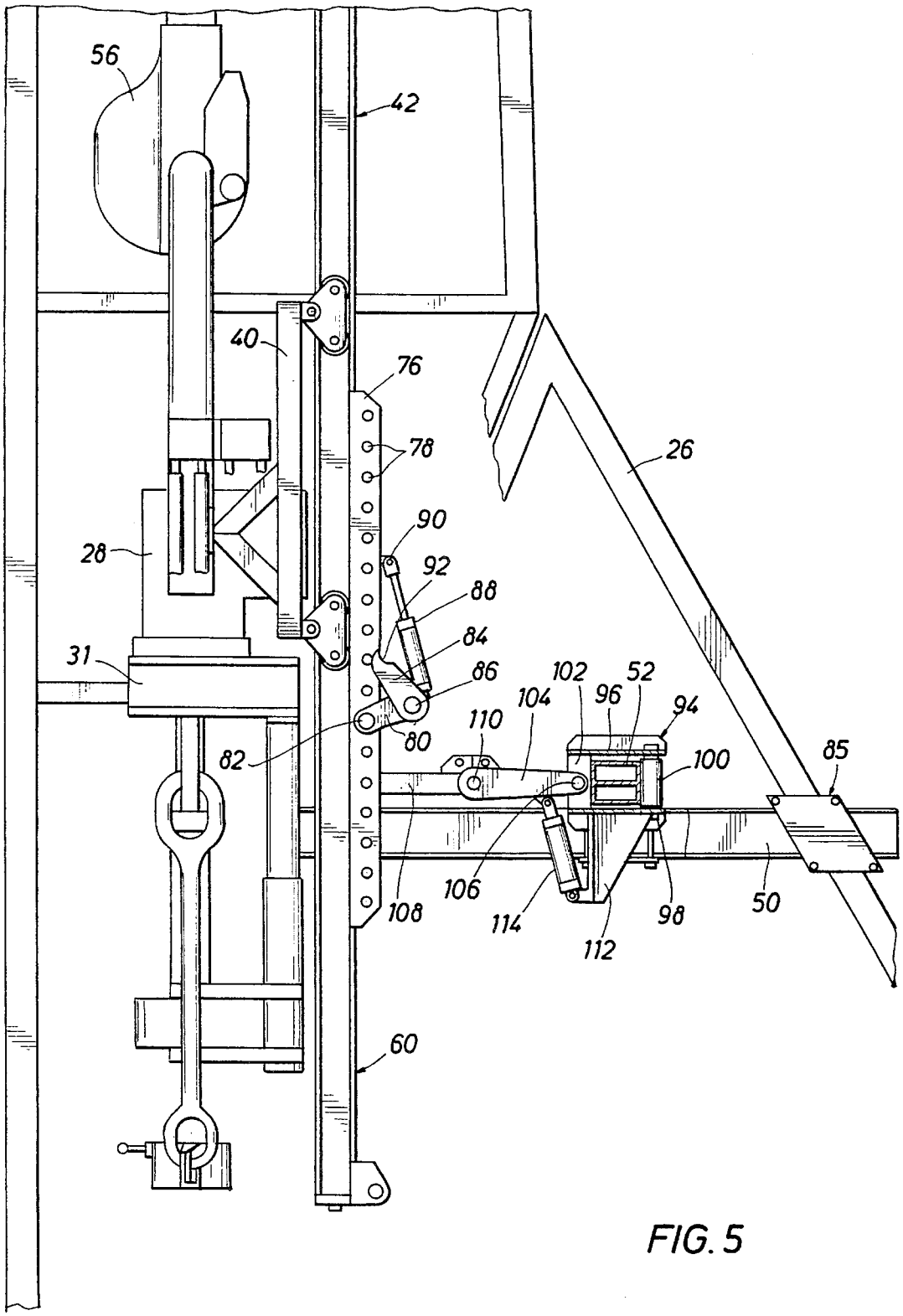
FIG. 5 is a detailed elevation view of the present invention during a drilling operation.
Figure 6:
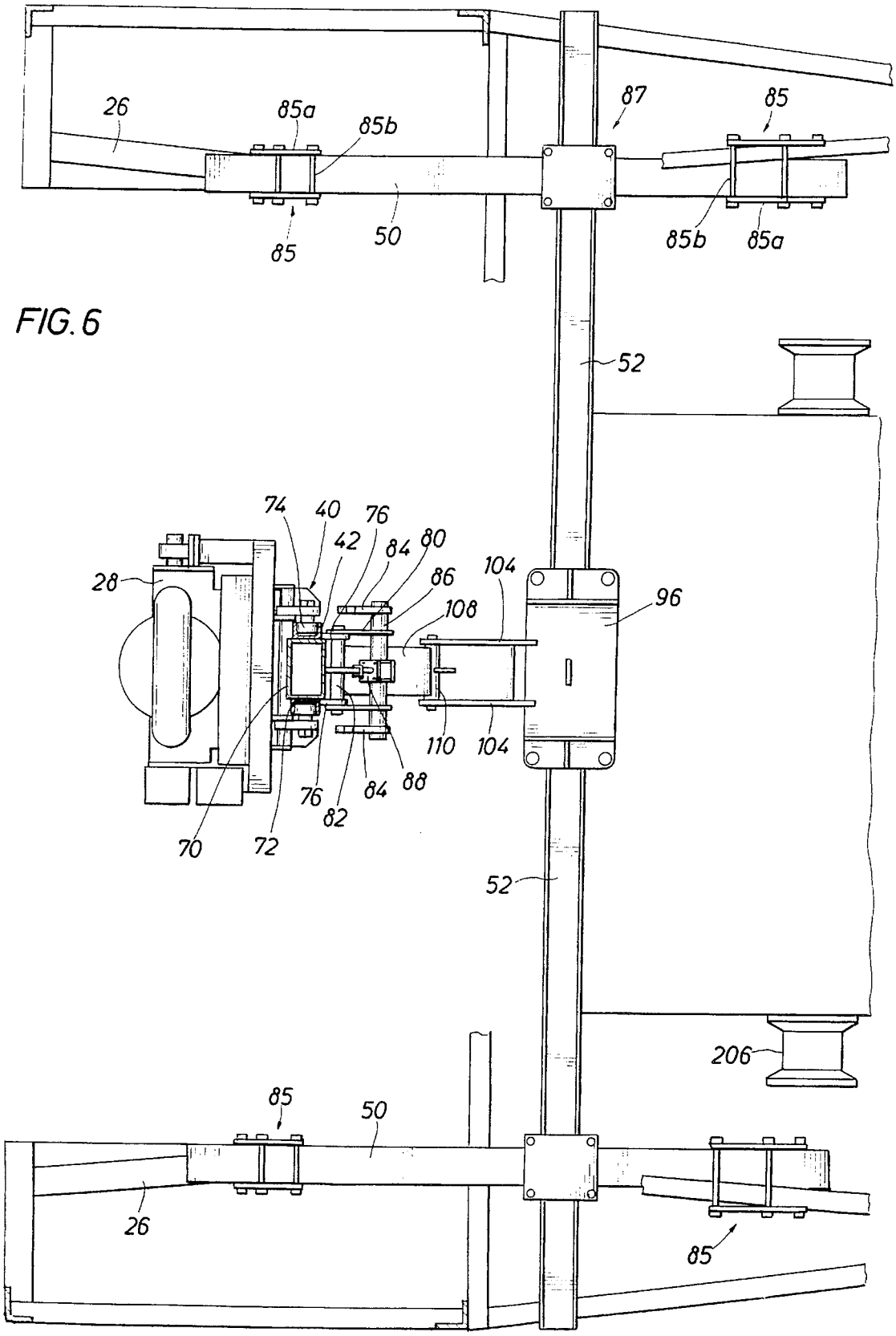
FIG. 6 is a plan view of the present invention during a drilling operation.
Figure 7:
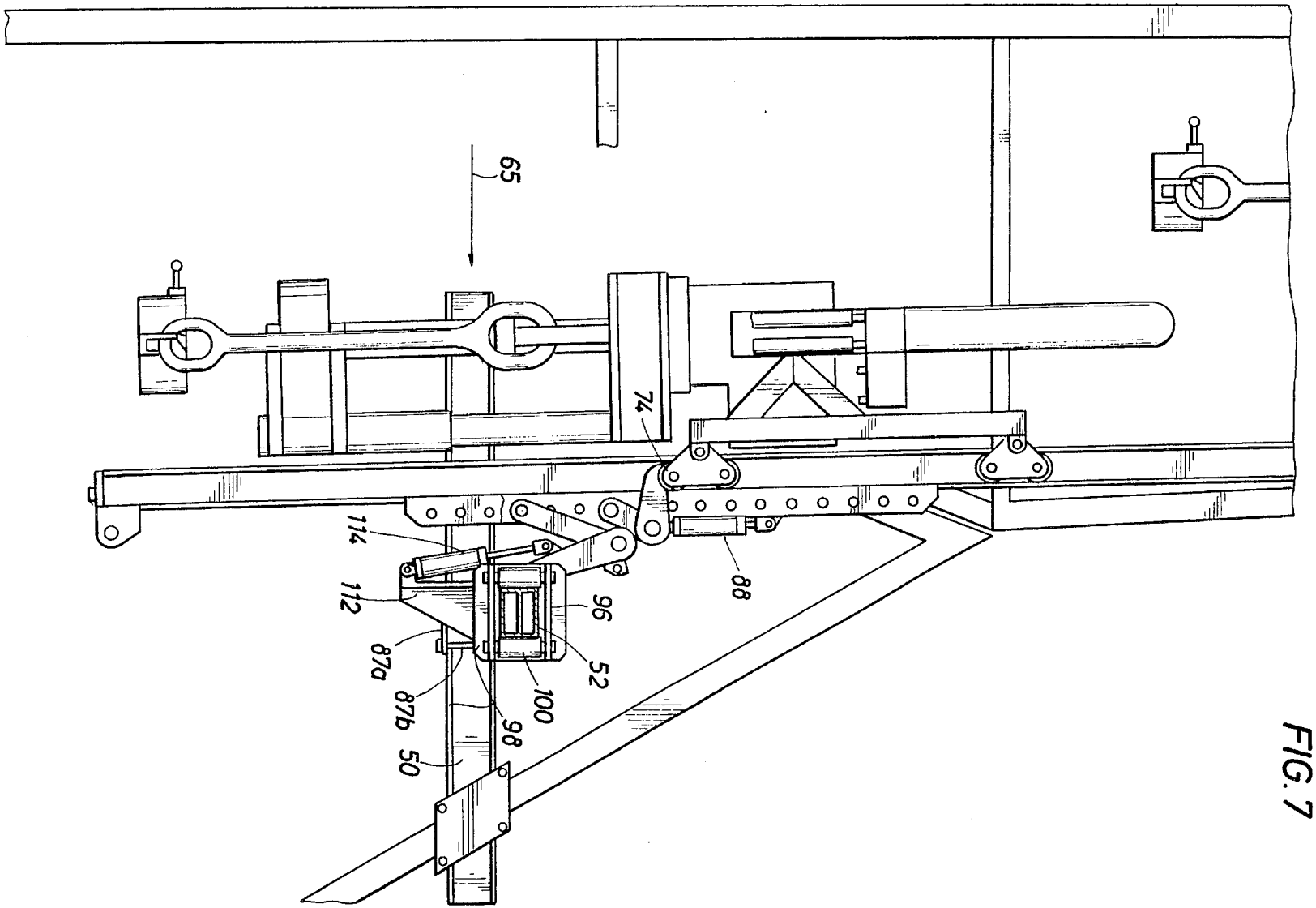
FIG. 7 is a detailed elevation view of the present invention displaced rearwardly in a first direction as shown in FIG. 4.

Reference is now made to FIGS. 5–7, particularly FIGS. 5 and 6. Top drive unit 28 is shown suspended by block 56 and displaceable along torque track 42 via carriage assembly 40. FIG. 5 is a detailed view of the present invention more generally shown in FIG. 2. As noted above, it is desirable to displace lower end 60 of track 42 and top drive 28 in a first direction shown by arrow 65 in FIG. 4. Members 50 are substantially parallel and have a longitudinal axis which coincides with the direction of arrow 65. As shown in FIGS. 5 and 6, torque track 42 comprises a hollow elongated member 70 which is generally rectangular in configuration. Channel irons 72 (also referred to as tracks) are attached at opposite sides of member 70. Tracks 72 provide lateral support for rollers 74 of carriage assembly 40. A plate 76 is attached near the lower end 60 of track 42 to each channel iron 72. Each plate 76 includes a series of apertures 78 positioned along its length which permit the adjustment of a portion of the present invention as described below. A pair of first arms 80 are pivotally attached through a pin 82 which passes through connecting apertures 78 of adjacent plates 76. A second pair of arms 84 are rigidly connected to the other end of arms 80 by a pin 86. A hydraulic cylinder 88 is attached at one end 90 to torque track 42 and its other end to pin 86. In this manner, activation of cylinder 88 will cause arms 84 to pivot about pin 82 as shown in FIG. 7. In this manner, a cup portion 92 of each arm 84 can be positioned to rest below a roller 74 of carriage assembly 40 (as shown in FIG. 7) and thereby support top drive unit 28 when disconnected from block 56.

Referring to FIGS. 6 and 7, each member 50 is bolted to A-frame 26 by plate and bolt connections 85. Each connection 85 comprises a pair of bearing plates 85*a* and interconnecting bolts 85*b*. Member 52 is fixedly attached at each of its ends to a member 50 by a similar plate and bolt connection 87 comprising a pair of bearing plates 87*a* and interconnecting bolts 87*b*.

Referring still to FIGS. 5–7, the present invention also includes a base sled 94 having a top plate 96 and a bottom plate 98 straddling member 52. Plates 96 and 98 are connected in spaced relationship by rollers 100. A vertical member 102 also spans the distance between plates 96 and 98. A first pair of arms 104 are attached at one end to plate 102 with a pin 106. A second arm 108 is attached at one end to plate 76 and attached at its other end to the opposing ends of arms 104 with a pin 110. A base support member 112 is attached to the lower side of bottom plate 98. A hydraulic cylinder 114 is attached at one end to base support member 112 and at its other end to arms 104. In this manner, activation of cylinder 114 articulates arms 104 and 108 as shown in FIG. 7. Since sled 94 is restrained from moving rearwardly because member 52 is fixedly connected to members 50, articulation of arms 104/108 causes the displacement of lower end 60 of track 42 in a direction substantially parallel with members 50 as shown by arrow 65 in FIG. 7.

Thus, activation of cylinder 88 articulates arms 80/84 into a position for suspending top drive unit 28 from torque track 42 and activation of cylinder 114 articulates arms 104/108 to retract or displace the lower end 60 of top drive 42 in a direction substantially parallel with members 50 away from the original location of top drive unit relative to the drill string.

Figure 8:
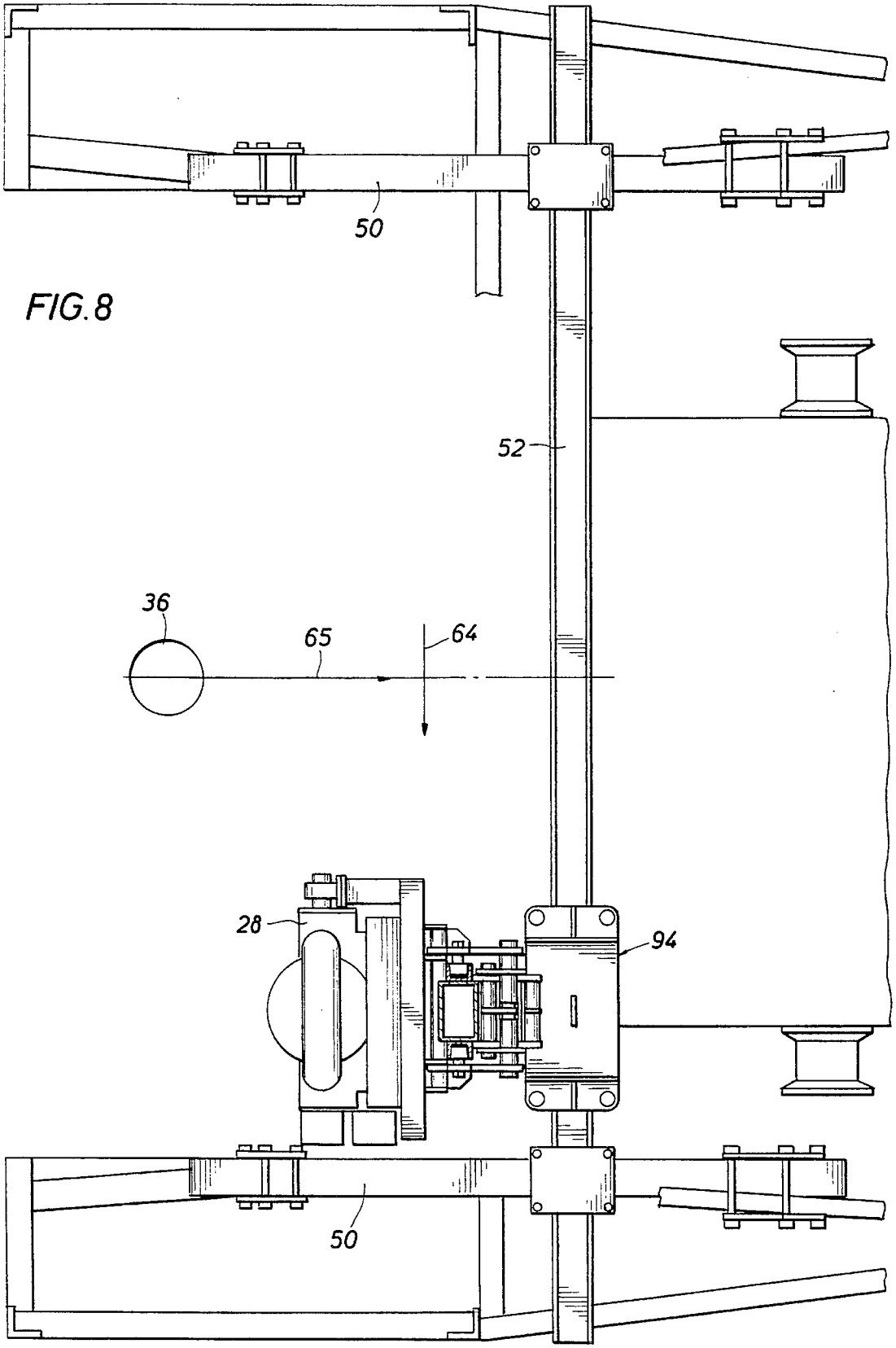
FIG. 8 is a detailed plan view of the present invention displaced laterally in a second direction as shown in FIG. 3.
Figure 9:
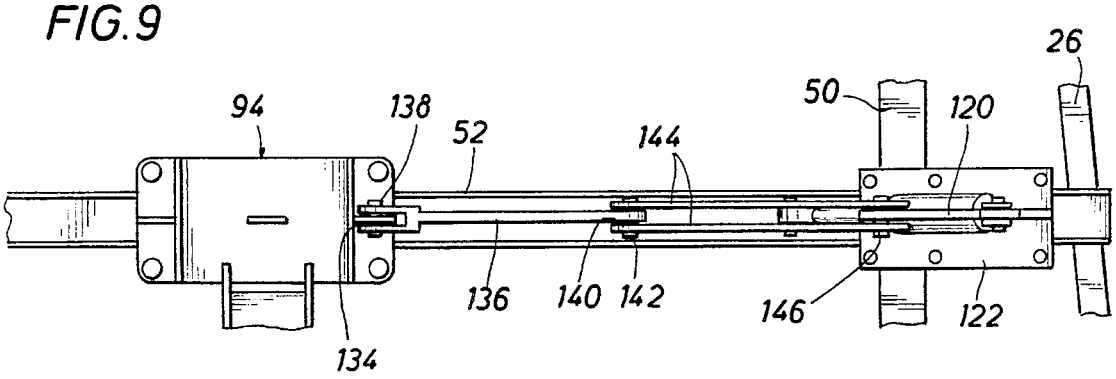
FIG. 9 is a detailed plan view of a portion of the present invention.
Figure 10:
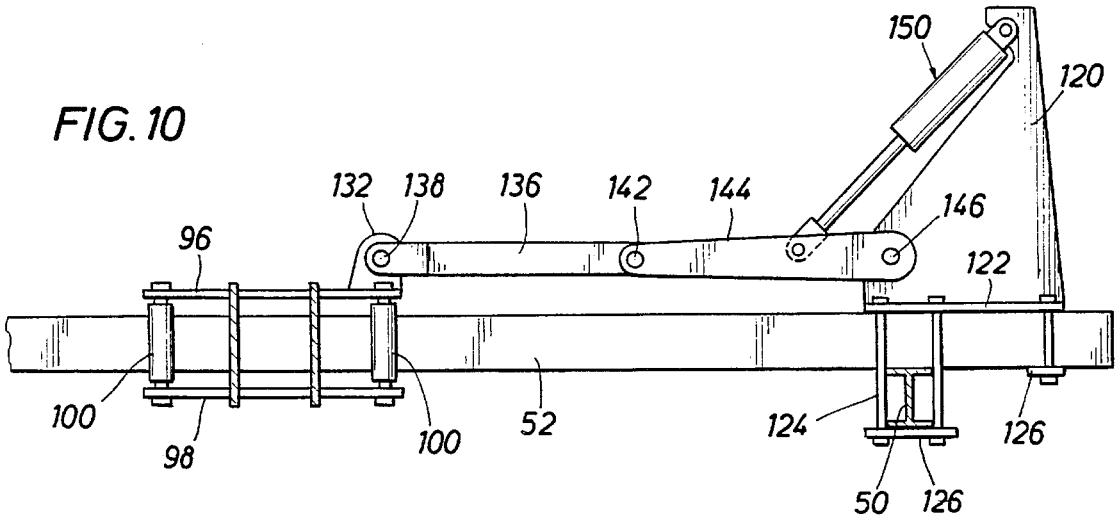
FIG. 10 is a detailed elevation view of the portion of the present invention shown in FIG. 9.
Figure 11:
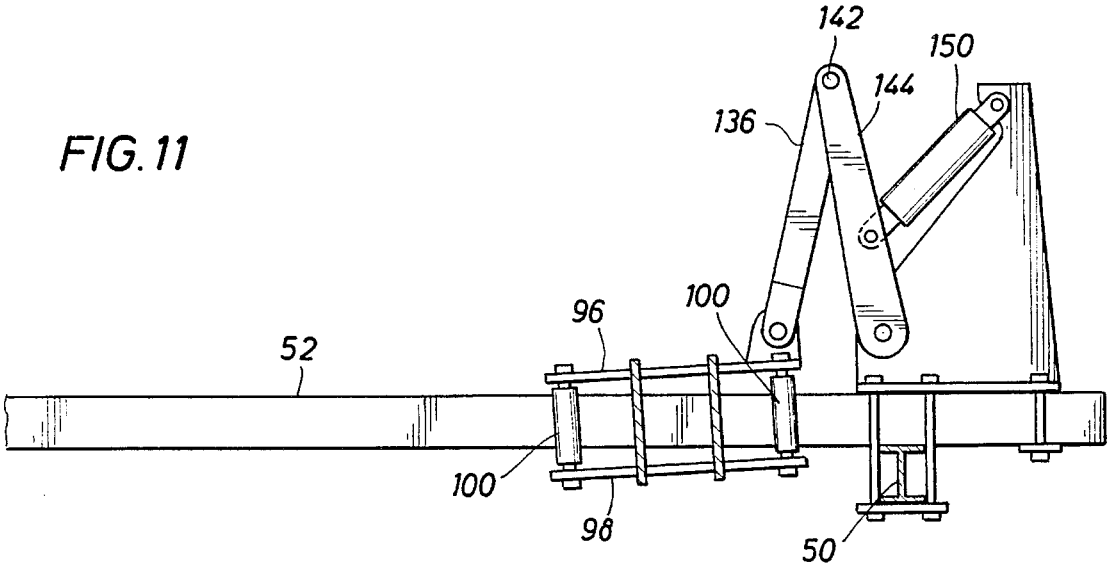
FIG. 11 is a detailed elevation view of a portion of the present invention.

Referring now to FIGS. 8–10, a second means for displacing the lower end 60 of torque track 42 and top drive 28 in a direction as shown by arrow 64. Referring first to FIG. 9, base sled 94 is shown supported on member 52. Members 50 are substantially normal to member 52 and structurally support member 52 as described above thereby directing any reactionary forces back into A-frame 26. A support member 120 is attached to one member 50 as shown in FIG. 10. Preferably, member 120 is bolted through a flange 122 and bolts 124 to plates 126 which fixedly attaches support member 120 to member 50 and member 52. Such connection also serves to further fix member 52 to one member 50 in addition to the bolted connection 87 described above. An eyelet 132 is attached to top plate 96 of sled 94 and includes an aperture 134. A first arm 136 is connected by a pin 138 through aperture 134 to eyelet 132. Arm 136 includes another aperture 140 at its opposite end adapted to engage a pin 142. A pair of second arms 144 also include end apertures and are connected by pin 142 to arm 136. The opposite end of arms 144 are connected by a pin 146 to support member 120. A hydraulic cylinder 150 is attached at one end to the top of support member 120 and at its opposite end to arms 144. When activated, as shown in FIG. 11, arms 136 and 144 are pivoted about pin 142 causing the displacement of base sled 94 in a direction substantially parallel with the longitudinal axis of member 52. In this manner, the lower end 60 of torque track 42 and top drive 28 are displaced in a second direction as generally shown by arrow 64 in FIG. 8 and FIG. 3. Since torque track 42 rotates about the top of mast 22, a pendulum motion occurs which causes base sled 94 to pivot as generally shown in FIG. 11. The length of rollers 100 are selected to prevent any binding which might occur betweens plates 96/98 and member 52.

FIG. 8 illustrates the final position of the lower end 60 of torque track 42 and top drive unit 28 after displacement by the first displacing means as generally shown in FIGS. 6 and 7 and the second displacing means as generally shown in FIGS. 8–11. As noted above, the displacement in a direction shown by arrow 65 substantially parallel to members 50 and in a direction shown by arrow 64 substantially parallel to member 52 may occur simultaneously. Additionally, the second displacing means as shown in FIGS. 10–11 may be positioned on either side of drill string 36 and may be used, for example, to advance the lower end 60 of torque track 42 and top drive unit 28 to the top of FIG. 8 rather than the bottom of FIG. 8 as shown.

In the operation of the present invention, drilling activity is first terminated. The suspension mechanism comprising plates 76, arms 80/84 and hydraulic cylinder 88 is activated to support top drive unit 28 from the lower end 60 of torque track 42 as described above and generally shown in FIGS. 5 and 6. Next, block 56 is disconnected from top drive unit 28 and top drive unit 28 is permitted to hang from the lower end of torque track 42 as shown in FIG. 7. At that point, either the first or second displacing mechanisms may be individually, or simultaneously, activated. In the case of the first displacing mechanism as shown in FIGS. 5–7, hydraulic cylinder 114 is activated, articulating arms 104/108 and displacing the lower end 60 of torque track 42 and top drive 28 rearwardly or in a direction shown by arrow 65 substantially parallel with members 50 as shown in FIG. 7. Additionally, hydraulic cylinder 150 is activated pivoting arms 136/144 and displacing base sled 94 as shown in FIGS. 8–11, moving the lower end 60 of torque track 42 and top drive unit 28 in a direction shown by arrow 64 substantially parallel to member 52 resulting in a final position as shown in FIG. 8.

FIGS. 3–4 and 12–13 illustrate alternate embodiments of the first and second displacing means. Referring to FIGS. 3–4, a hoisting cable 200 is shown attached at one end to power swivel 31 of top drive unit 28 passing around a pulley 202 fixedly attached to members 50, continuing upwardly passing around a pulley 204 at the top of mast 22 and extending downwardly to a utility winch 206 (see FIG. 6). In this manner, at the appropriate time, motors (not shown) may activate winch 206 which draws in cable 200 displacing the lower end 60 of torque track 42 and top drive 28 in a direction shown by arrow 64 substantially parallel to member 52.

Figure 12:
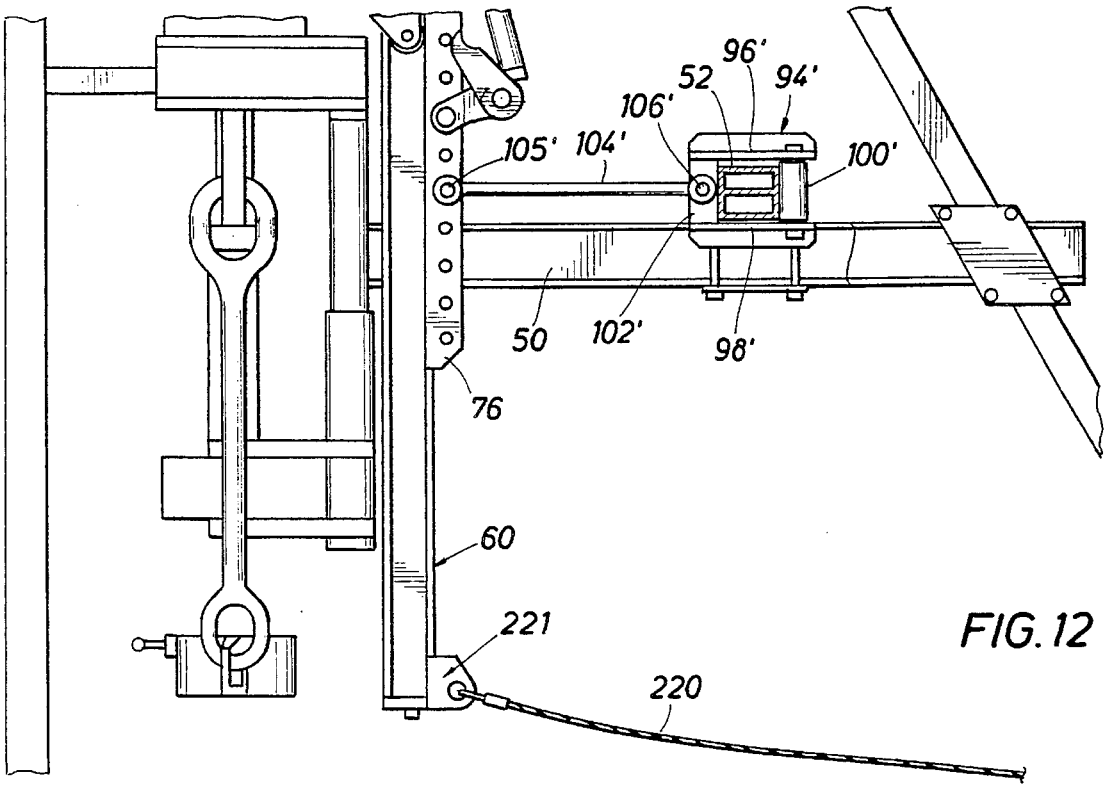
FIG. 12 is an alternate embodiment of a portion of the present invention.
Figure 13:
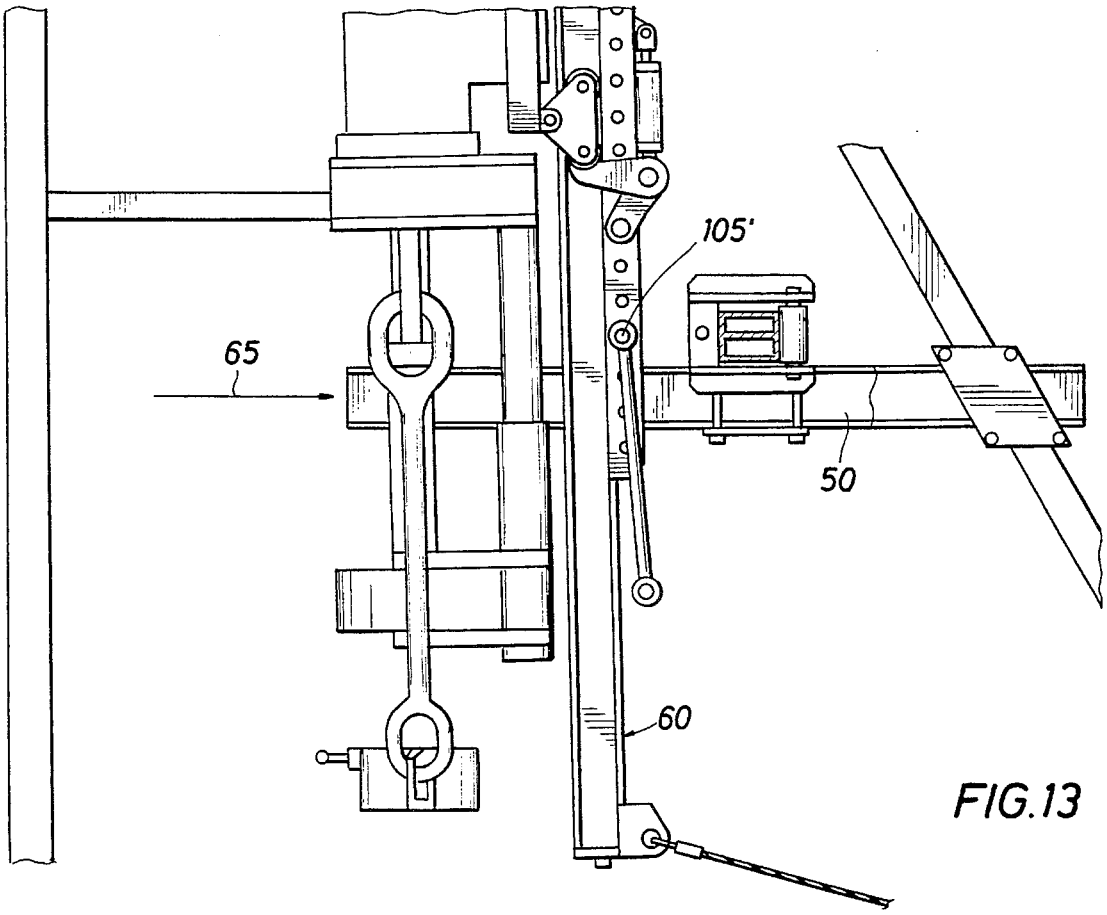
FIG. 13 is another view of the alternate embodiment shown in FIG. 12.

Referring to FIGS. 12–13, base sled 94' comprises a top plate 96' and a bottom plate 98' connected by rollers 100' and a vertical member 102'. A link 104' having eyelets at either end is connected at one end to plate 76 through a selected aperture 78 and fixed in position by a pin 105'. The opposite end of link 104' is connected to member 102' by a pin 106'. A cable 220 is attached to the lower end 60 of torque track 42 through an eyelet 221. In operation, either pin 105' or 106' is removed permitting link 104' to pivot about the remaining pin (pin 105' as shown in FIG. 13). At that point, a utility winch, such as winch 206, draws in cable 220 thereby displacing the lower end 60 of torque track 42 and top drive 28 in a direction shown by arrow 65 substantially parallel to members 50 as shown in FIG. 13.

The present invention has been described in terms of a preferred embodiment and an alternate embodiment. Obviously, modifications and alterations to these embodiments will be apparent to those skilled in the art in view of this disclosure. However, it is intended that all such variations and equivalent modifications fall within the spirit and scope of the present invention as claimed.

What is claimed is:

1. In a derrick having a connection proximate the top of the derrick to suspend a torque track therefrom which guides a top drive drill unit used to drill a well, an apparatus for displacing one end of the torque track proximate the well, said apparatus comprising:

means for temporarily suspending the top drive drill unit from the one end of the torque track proximate the well;

first means for displacing the one end of the torque track proximate the well in a first direction about the connection of said torque track to said derrick; and second means for displacing the one end of the torque track proximate the well in a second direction substantially normal to the first direction about the connection of said torque track to said derrick.

2. In a derrick having a connection proximate the top of the derrick to suspend a torque track therefrom which guides a top drive drill unit used to drill a well, an apparatus for displacing one end of the torque track proximate the well, said apparatus comprising:

means for suspending the top drive drill unit near the one end of the torque track proximate the well;

first means for displacing the one end of the torque track proximate the well in a first direction about the connection to said torque track to said derrick; and second means for displacing the one end of the torque track proximate the well in a second direction about the connection of said torque track to said derrick.

3. In a derrick having a connection proximate the top of the derrick to suspend a torque track therefrom which guides a top drive drill unit used to drill a well, an apparatus for displacing one end of the torque track proximate the well, said apparatus comprising:

means for temporarily suspending the top drive drill unit from the one end of the torque track proximate the well;

first means for displacing the one end of the torque track proximate the well in a first direction about the connection of said torque track to said derrick;

second means for displacing the one end of the torque proximate the well track in a second direction about the connection of said torque track to said derrick; and means for securing the one end of the torque track proximate the well once displaced by the first and second means.

4. In a derrick having a connection proximate the top of the derrick to suspend a torque track therefrom which guides a top drive drill unit used to drill a well, an apparatus for displacing one end of the torque track proximate the well, said apparatus comprising:

means for temporarily suspending the top drive drill unit from the one end of the torque track proximate the well;

first means for displacing the one end of the torque track proximate the well in a first direction about the connection of said torque track to said derrick;

second means for displacing the one end of the torque track proximate the well in a second direction substantially normal to the first direction about the connection of said torque track to said derrick; and means for securing the one end of the torque track proximate the well once displaced by the first and second means.

5. In a derrick used to drill a well, well equipment comprising:

a torque track connected to and suspended from the top of the derrick and extending downwardly proximate the well;

a top drive drill unit, engageable with said torque track and adapted to be advanced along the length of said torque track during drilling operations;

a first means for displacing one end of said torque track in a first direction proximate the well about the connection of said torque track at the top of the derrick; and a second means for displacing the one end of said torque track proximate the well in a second direction substantially normal to the first direction about the connection of said torque track at the top of the derrick.

6. The apparatus according to claim 5 wherein said first displacing means comprises (a) a base in spaced relationship with the derrick and displaceable in a direction substantially normal to the first direction, (b) a linkage assembly having an articulated member attached at one end to said torque track and at its other end to said base, and (c) means for articulating said articulated member thereby displacing the one end of said torque track in the first direction.

7. The apparatus according to claim 6 wherein said second displacing means comprises (a) a linkage assembly having an articulated member attached at one end to said base of said first displacing means and at its other end to the derrick, and (b) means for articulating said articulated member thereby displacing said base and the one end of said torque track in the second direction.

8. In a derrick used to drill a well, well equipment comprising:

a torque track connected to and suspended from the top of the derrick and extending downwardly proximate the well;

a top drive drill unit engageable with said torque track and adapted to be advanced along the length of said torque track during drilling operations;

means for temporarily suspending said top drive drill unit from one end of said torque track proximate the well;

first means for displacing the one end of said torque track proximate the well in a first direction about the connection of said torque track at the top of the derrick; and second means for displacing the one end of said torque track proximate the well in a second direction substantially normal to the first direction about the connection of said torque track at the top of the derrick.

9. In a derrick used to drill a well, well equipment comprising:

a torque track suspended from the top of the derrick and extending downwardly proximate the well;

a top drive drill unit, engageable with said torque track and adapted to be advanced along the length of said torque track during drilling operations;

means for temporarily suspending said top drive drill unit from one end of said torque track proximate the well comprising (a) a base attached to said torque track, (b) a linkage assembly having an articulated member attached at one end to said base and having a hook portion at its other end adapted to engage and support said top drive drill unit, and (c) means for articulating said articulated member about its other end so as to pivot said articulated member and engage said hook portion to said top drive drill unit;

means for displacing the one end of said torque track proximate the well in a first direction; and means for displacing the one end of the torque track proximate the well in a second direction.

10. In a derrick used to drill a well, well equipment comprising:

a torque track suspended from the top of the derrick and extending downwardly proximate the well;

a top drive drill unit engageable with said torque track and adapted to be advanced along the length of said torque track during drilling operations;

means for temporarily suspending said top drive drill unit from one end of said torque track proximate the well;

first means for displacing the one end of said torque track proximate the well in a first direction comprising (a) a base in spaced relationship with the derrick and displacable in a direction substantially normal to the first direction, (b) a linkage assembly having an articulated member attached at one end to said torque track and a second end to said base, and (c) means for articulating said articulated member thereby displacing the one end of said torque track proximate the well in the first direction; and second means for displacing the one end of said torque track proximate the well in a second direction comprising (a) a linkage assembly having an articulated member attached at one end to said base of said first displacing means and at its other end to the derrick, and (b) means for articulating said articulated member thereby displacing said base and the one end of said torque track proximate the well in the second direction.

11. In a derrick used to drill a well, well equipment comprising:

a torque track suspended from the top of the derrick and extending downwardly proximate the well;

a top drive drill unit engageable with said torque track and adapted to be advanced along the length of said torque track during drilling operations;

means for temporarily suspending said top drive drill unit from the end of said torque track proximate the well comprising (a) a base attached to said torque track, (b) a linkage assembly having an articulated member attached at one end to said base and having a hook portion in its other end adapted to engage and support said top drive, and (c) means for articulating said articulated member about its other end so as to pivot said articulated member and engage said hook portion to said top drive drill unit;

first means for displacing one end of said torque track proximate the well in a first direction;

second means for displacing the one end of the torque track proximate the well in a second direction substantially normal to said first direction; and means for securing the one end of the torque track proximate the well once displaced by said first and second displacing means.

12. In a derrick used to drill a well, well equipment comprising:

a torque track suspended from the top of the derrick and extending downwardly proximate the well;

a top drive drill unit engageable with said torque track and adapted to be advanced along the length of said torque track during drilling operations;

means for temporarily suspending said top drive drill unit from one end of said torque track proximate the well comprising (a) a base member attached to said torque track, (b) a linkage assembly having an articulated member attached at one end to said base member and having a hook portion in its other end adapted to engage and support said top drive, and (c) means for articulating said articulated member about its other end so as to pivot said articulated member and engage said hook portion to said top drive drill unit;

first means for displacing the one end of said torque track proximate the well in a first direction comprising (a) a base platform in spaced relationship with the derrick and displacable in a direction substantially normal to the first direction, (b) a linkage assembly having an articulated member attached at one end to said torque track and a second end to said base platform, and (c) means for articulating said articulated member thereby displacing the one end of said torque track proximate the well in the first direction; and second means for displacing the one end of the torque track proximate the well in a second direction comprising (a) a linkage assembly having an articulated member attached at one end to said base platform of said first displacing means and at its other end to the derrick, and (b) means for articulating said articulated member thereby displacing said base platform and the one end of said torque track in the second direction.

13. In a derrick having a connection proximate the top of the derrick to suspend a torque track therefrom which guides a top drive drill unit used to rotate a drill string to drill a well, a method for displacing one end of the torque track proximate the well, said method comprising the steps of:

disengaging the drill string from the top drive drill unit;

suspending the top drive drill unit from the one end of the torque track proximate the well;

displacing the one end of the torque track proximate the well in a first direction about the connection of said torque track to said derrick; and displacing the one end of the torque track proximate the well in a second direction about the connection of said torque track to said derrick.

14. In a derrick having a connection proximate the top of the derrick to suspend a torque track therefrom which guides a top drive drill unit used to rotate a drill string to drill a well, a method for displacing one end of the torque track proximate the well, said method comprising the steps of:

disengaging the drill string from the top drive drill unit;

suspending the top drive drill unit from the one end of the torque track proximate the well;

displacing the one end of the torque track in a first direction about the connection of said torque track to said derrick;

displacing the one end of the torque track proximate the well in a second direction substantially normal to the first direction about the connection of said torque track to said derrick; and securing the lower end of the torque track once displaced in the first and second directions.

* * * * *